US007441778B2

(12) United States Patent
Waken

(10) Patent No.: US 7,441,778 B2
(45) Date of Patent: Oct. 28, 2008

(54) METHOD FOR PLAYING A WAGERING GAME

(76) Inventor: Steven M. Waken, 15049 Wedgewood Dr., Hacienda Heights, CA (US) 91745

( * ) Notice: Subject to any disclaimer, the term of this patent is extended or adjusted under 35 U.S.C. 154(b) by 206 days.

(21) Appl. No.: 10/974,632

(22) Filed: Oct. 26, 2004

(65) Prior Publication Data

US 2006/0087080 A1 Apr. 27, 2006

(51) Int. Cl.
*A63F 3/08* (2006.01)

(52) U.S. Cl. ..... 273/274; 273/292

(58) Field of Classification Search ..... 273/274
See application file for complete search history.

(56) References Cited

U.S. PATENT DOCUMENTS 5,590,883 A * 1/1997 Brewer ..... 273/249
5,653,445 A * 8/1997 Quach ..... 273/292
6,332,614 B1 * 12/2001 Hesse ..... 273/292
6,554,282 B2 * 4/2003 VanderKley et al. ..... 273/292
6,824,137 B2 * 11/2004 Foster et al. ..... 273/292
2003/0034610 A1 * 2/2003 VanderKley et al. ..... 273/292
2004/0090006 A1 * 5/2004 Foster et al. ..... 273/292
2005/0001378 A1 * 1/2005 Lo ..... 273/292

* cited by examiner

*Primary Examiner*—Gene Kim
*Assistant Examiner*—Alyssa M Hylinski
(74) *Attorney, Agent, or Firm*—Lawrence S. Cohen

(57) ABSTRACT

The present invention comprises a wagering game in which at least one player, but preferably a plurality of players, plays against a banker. Each player and the banker are dealt five cards, discard a card, and then a common starter card is turned face up from the deck. The four kept cards and the starter card form five card hands. The hands are scored according to the rules of Cribbage. In an alternative embodiment, the game also employs the two hand feature of Pai Gow Poker.

3 Claims, 6 Drawing Sheets

METHOD FOR PLAYING A WAGERING GAME

TECHNICAL FIELD

The present invention pertains generally to wagering card games, and more particularly to a card game in which players each play against a banker. The scoring of hands is taken from the game of Cribbage. In a second embodiment of the invention, the two hand feature of Pai Gow Poker is also employed.

BACKGROUND OF THE INVENTION

Numerous card games include a plurality of players each playing against a banker rather than playing against each other. Blackjack and Pai Gow poker are two examples of such games. Conversely, in the game of Cribbage players play against each other. Each player accumulates points based on an old and well established Cribbage scoring system, wherein the player who first reaches 120 points is the winner.

BRIEF SUMMARY OF THE INVENTION

The present invention is directed to a method of playing a wagering card game which combines play against a banker with the scoring system of Cribbage. The game may be house-banked or alternatively banked by a player/banker. The recommended number of players is seven in a house-banked game, or eight in a player/banker game. Initially each player (not the banker) places a wager. The players may optionally place a bonus wager which pays off if the total point value of a hand reaches a certain level. Five cards are dealt to each player and to the banker. The players and the banker then look at their five cards and discard one of the cards. In an alternative embodiment the players and the banker each receive six cards and discard two cards. After the players have discarded, the banker's cards can be turned face up on the table. A "starter card" is then dealt face up from the deck. The starter card is a common card that is used by all players and the banker along with their four kept cards to form five card hands. All hands are then assigned a total point value according to the scoring system of Cribbage. The players then take turns comparing their hands with the hand of the banker to determine who wins the wager.

The game of Cribbage has a very large following in the United States and Great Britain. Similarly the games of poker, blackjack, and Pai Gow Poker are quite popular. As such, a game such as the present invention which combines elements of these well know games will be attractive to a broad spectrum of players. A preferred name for the game is "29".

In accordance with a preferred embodiment of the invention, a method for playing a wagering game between a banker and one or more players includes:

(a) providing a conventional deck of 52 cards, the cards having the following numerical values:

an ace equals one;

face cards equal ten; and, all other cards equal their face value;

(b) each player placing a wager;

(c) dealing five cards from the deck to each player and to banker;

(d) each player and banker keeping four cards and discarding a card;

(e) from the deck turning a starter card face up, wherein each player and the banker use the starter card and the four cards from step (d) to form a five card hand;

(f) each player and the banker computing a total point value for their five card hands of step (e) as follows two points for each combination of cards which numerically sum to 15;

two points for each pair of cards of the same rank;

one point for each card in a sequence of three or more consecutive cards;

four points if all said four cards of step (d) are the same suit;

five points if all said four cards of step (d) and said starter card of step (e) are the same suit;

one point if one of said four cards of step (d) is the jack of the suit of said starter card of step (e);

(g) each player comparing their total point value of step (f) with the total point value of the banker; and, (h) in step (g) if the total point value of the player is greater than the total point value of the banker the player winning the wager of step (b), or if the total point value of the player is less than the total point value of the banker the banker winning the wager of step (b).

In accordance with an aspect of the invention:

in step (g), if the total point value of the player is equal to the total point value of the banker, the banker winning the wager of step (b).

In accordance with another aspect of the invention:

in step (e), if the starter card is a jack, the banker adding two points to his or her total point value of step (f).

In accordance with another aspect of the invention:

in step (c), dealing one additional card to each player and to the banker; and, in step (d), each player and the banker keeping four cards and discarding two cards.

In accordance with another aspect of the invention:

in step (c), dealing one additional card to the banker; and, in step (d), the banker keeping four cards and discarding two cards.

In accordance with another aspect of the invention:

in step (f), if the computed total point value is zero, the total point value being changed to 19.

In accordance with another aspect of the invention:

prior to step (c), the player placing a bonus wager; and, the player receiving a bonus payoff if the total point value of the player's hand has a predetermined value.

In accordance with another aspect of the invention:

a "lowball" variation is provided wherein if the total point value of the player is less than the total point value of the banker the player wins the wager of step (b), or if the total point value of the player is greater than the total point value of the banker the banker wins the wager of step (b).

In accordance with another aspect of the invention, the method further including:

a Pai Gow Poker embodiment is provided wherein the players and the banker are each dealt six cards and arrange the cards into a four card group and a two card group. The four card group is combined with the starter card to form a first five card hand. The two card group is combined with the starter card and a two card starter crib to form a second five card hand. The players each compare their first five card hand with the first five card hand of the banker and their second five card hand with the second five card hand of the banker. In order to win, the player or banker must win both the first and second five card hands.

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
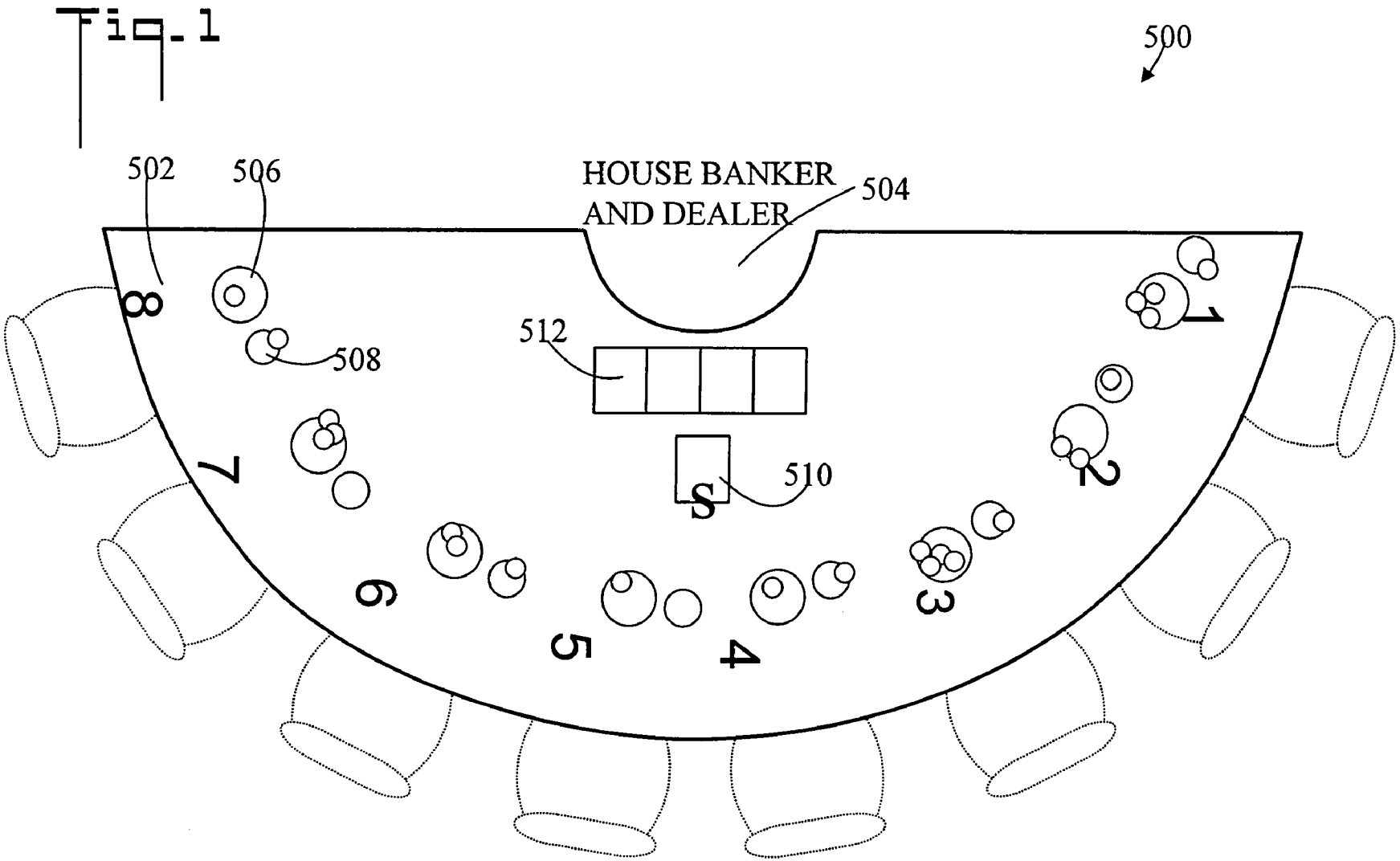
FIG. 1 is a plan view of a playing table which is used in the method of the present invention.

Referring initially to FIG. 1, there is illustrated a plan view of a playing table 500 which is used in the method of the present invention. Playing table 500 includes a plurality of playing positions 502, eight in the shown embodiment, and a position 504 for a house banker who also serves as the dealer. That is, in this embodiment the house banker is the banker, and each of the players play against the house banker. Indicia depicting a wagering area 506 and a bonus wagering area 508 are provided for each playing position. For example, Player 3 has placed a four chip wager and a one chip bonus wager. Indicia is also provided to receive a "starter card" 510 and four card positions 512 upon which the house banker's cards may be displayed face up. In this embodiment each of the players plays against the house banker.

Figure 2:
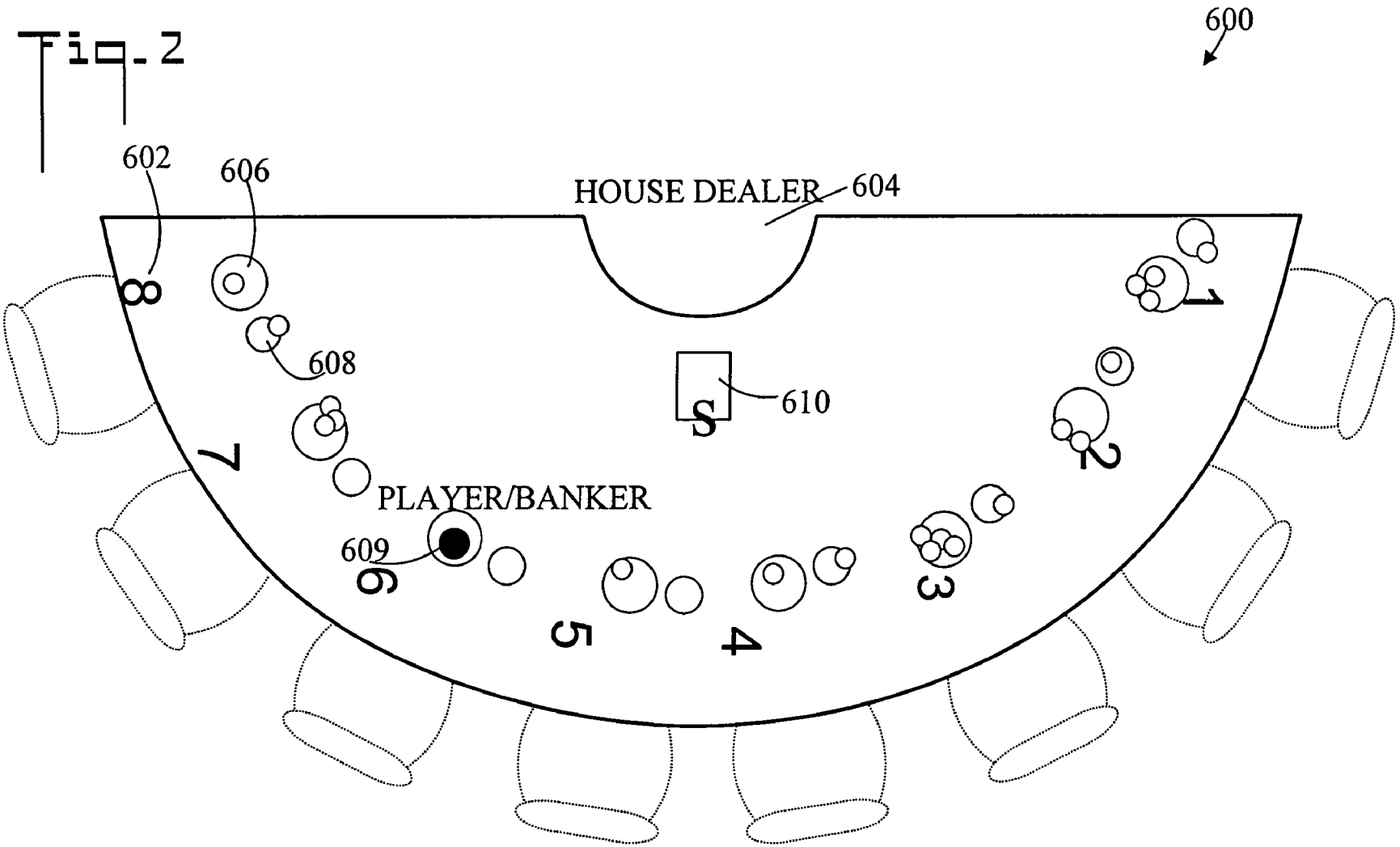
FIG. 2 is plan view of a second embodiment of the playing table.

Now referring to FIG. 2, there is illustrated a plan view of a second embodiment playing table 600. Playing table 600 includes a plurality of playing positions 602, eight in the shown embodiment, and a position 604 for a house dealer. Indicia depicting a wagering area 606 and a bonus wagering area 608 are provided for each playing position. In this embodiment the house dealer only deals and does not serve as the banker. Rather the banker function is provided by a player/banker who is selected from amongst the players (player number 6 in the shown embodiment as designated by player/banker marker 609). That is, in this embodiment the player/banker is the banker, and all other players play against the player/banker. Indicia is also provided to receive a "starter card" 610.

It is noted that the maximum number of participating players is limited to ten by the number of available cards (52); nine players plus the banker in the embodiment of FIG. 1, and ten players in the embodiment of FIG. 2.

Figure 3A:
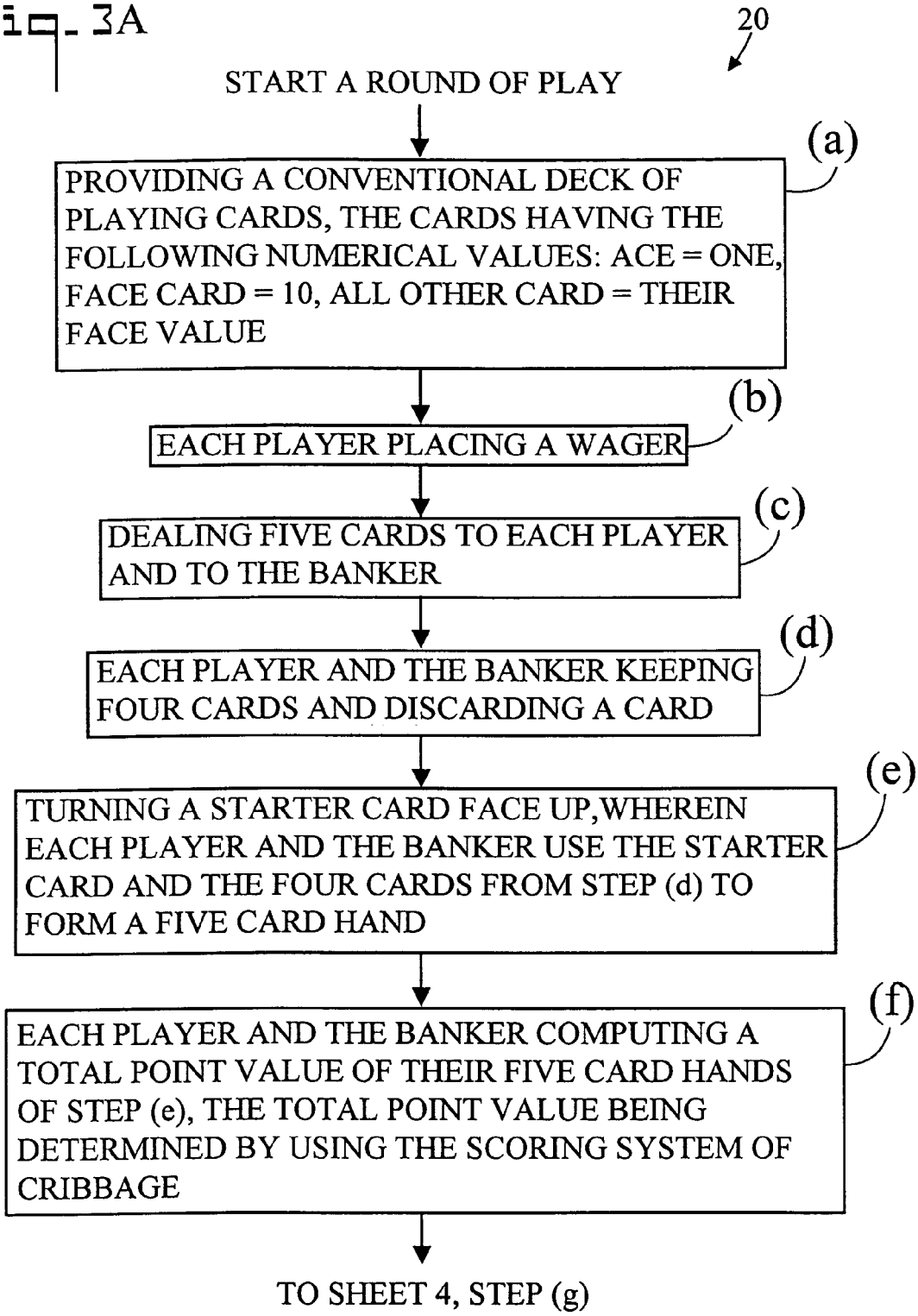
FIGS. 3A and 3B are a flow chart depicting a method for playing a wagering game between a banker and at least one player; and, FIGS. 4A and 4B are a flow chart depicting a method for playing a second embodiment of a wagering game between a banker and at least one player.
Figure 3B:
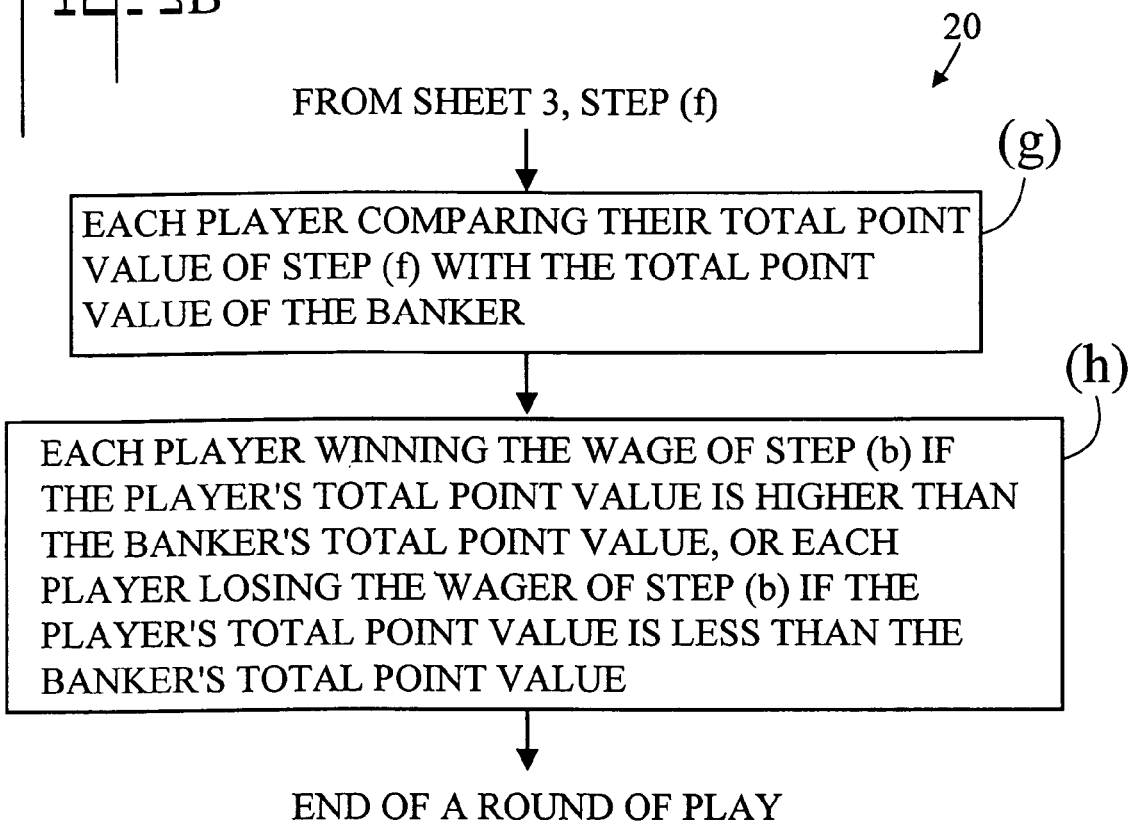

FIG. 3 is a flow chart depicting a method for playing a wagering game between a banker and at least one player, the method generally being designated as 20. While method 20 can include only one player and a banker, a plurality of players are preferred.

A round of play starts with step (a) in which a conventional deck of 52 playing cards is provided, the cards having the following numerical values:

an ace equals one;

face cards (jack, queen, and king) equal ten; and, all other cards equal their face value (e.g. a 6 equals six, a 10 equals ten, etc.):

In step (b) each of the players (but not the banker) places a wager.

In step (c) a dealer deals five cards from the deck of cards to each player and to the banker. The dealer may be the house banker (refer to FIG. 1), or a non-participating house dealer (refer to FIG. 2).

In step (d), each player and the banker review their respective cards, and then keep four cards and discard a card. In determining the card to discard, the players try to create four cards which in combination with the starter card will have the maximum total point value.

In step (e), a starter card is turned face up from the deck. Each player and the banker use the starter card and the four cards from step (d) to form a five card hand.

In step (f) each player and the banker compute a total point value for the five card hands of step (e) as follows:

two points for each combination of cards which numerically sum to 15. For example, (7 and 8), (5 and 10,) (6 and 9), (2, 6, 3, and 4), etc.;

two points for each pair of cards of the same rank (pair). For example, two threes, two nines, two Jacks, etc;

one point for each card in a sequence of three or more consecutive cards (run). For example, (9, 10, J), (4, 5, 6, 7), etc.

four points if all said four cards of step (d) are the same suit (four card flush). For example, the 2, 6, 8, and Q of clubs;

five points if all said four cards of step (d) and said starter card of step (e) are the same suit (five card flush). For example the 2, 4, 6, 10, and K of spades;

one point if one of the four cards of step (d) is the jack of the suit of the starter card of step (e). The jack of the same suit is referred to as the "Nobs";

Table 1 provides a sample round of play showing the hands of each player and the banker.

TABLE 1

Sample Round of Play

| | Four kept cards | Discard | Score | |
|---|---|---|---|---|
| Player 1 | As, 6s, 9s, Js | 2s | 3 combs. of 15 = | 6 |
| | Starter Card 5c | | flush of 4 = | 4 |
| | | | Total | 10 |
| Player 2 | 6d, 7c, 7h, 8s | Qc | 2 combs. of 15 = | 4 |
| | Starter Card 5c | | 1 pair = | 2 |
| | | | 2 runs of 4 = | 8 |
| | | | Total | 14 |
| Player 3 | 2h, 5d, 8d, 8h | 9h | 4 combs of 15 = | 8 |
| | Starter Card 5c | | 2 pair = | 4 |
| | | | Total | 12 |
| Player 4 | 4s, 5h, 5s, 6c | 8c | 4 combs. of 15 = | 8 |
| | Starter Card 5c | | 3 pair = | 6 |
| | | | 3 runs of 3 = | 9 |
| | | | Total | 23 |
| Player 5 | Ah, 4h, Kd, Kh | 2c | 4 combs. of 15 = | 8 |
| | Starter Card 5c | | 1 pair = | 2 |
| | | | Total | 10 |
| Player 6 | 9c, 10s, Jc, Qh | Ad | 3 combs. of 15 = | 6 |
| | Starter Card 5c | | run of 4 = | 4 |
| | | | "Nobs" = | 1 |
| | | | Total | 11 |
| Player 7 | 3d, 3s, 4c, Qd | 9d | 2 combs. of 15 = | 4 |
| | Starter Card 5c | | 1 pair = | 2 |
| | | | 2 runs of 3 = | 6 |
| | | | Total | 12 |
| Player 8 | 10c, 10d, 10h, Jh | Ac | 4 combs. of 15 = | 8 |
| | Starter Card 5c | | 3 pair = | 6 |
| | | | Total | 14 |
| Banker | 2d, 3h, 3c, 4d | 7d | 1 comb. of 15 = | 2 |
| | Starter Card 5c | | 1 pair = | 2 |
| | | | 2 runs of 4 = | 8 |
| | | | Total | 12 |

Referring to Table 1, in step (c), Player 1 was dealt the Ace of Spades, 6 of Spades, 9 of Spades, Jack of Spades, and the 2 of Spades (abbreviated as As,6s,9s,Js,2s). In step (d) Player 1 discards the 2s and keeps the As, 6s, 9s, and Js. In step (e) a starter card (5c) is turned face up from the cards remaining in the deck after the deal of step (c). This is typically accomplished by cutting a card from the cards remaining in the deck. In step (f), Player 1 computes the total point value of the four cards of step (d) and the starter card as follows, wherein an ace has a value of one, face cards have a value of ten, and all other cards have their face value:

| | |
|---|---|
| three combinations of cards which sum to 15<br>(6s, 9s), (As, 9s, 5c), (Js, 5c) | 6 points |
| four cards of the same suit (four card flush)<br>(As, 6s, 9s, Js) | 4 points |
| Total point value | 10 points |

Similarly, Player 2 is dealt the 6d,7c,7h,8s, and Qc, discards the Qc, and computes a total point value as follows:

| | |
|---|---|
| two combinations of 15<br>(7c, 8s), (7h, 8s) | 4 points |
| one pair<br>(7c, 7h) | 2 points |
| two runs of four cards<br>(5c, 6d, 7c, 8s), (5c, 6d, 7h, 8s) | 8 points |
| Total point value | 14 points |

It is noted that the cards comprising a run do not have to be of the same suit. Runs can be three, four, or five cards. Also, runs cannot cross the ace-king boundary. Or in other words, an ace and a king cannot appear together in a run. For example, (Qc, Kd, As, 2h) or (Ks, Ah, 2c) are not runs.

Similarly, Player 3 is dealt the 2h,5d,8d,8h, and 9h, discards the 9h, and computes a total point value as follows:

| | |
|---|---|
| four combinations of 15<br>(2h, 5d, 8d), (2h, 5d, 8h), (2h, 5c, 8d), (2h, 5c, 8h) | 8 points |
| two pairs<br>(5d, 5c), (8d, 8h) | 4 points |
| Total point value | 12 points |

Similarly, Player 4 is dealt the 4s,5h,5s,6c, and 8c, discards the 8c, and computes a total point value as follows:

| | |
|---|---|
| four combinations of 15<br>(4s, 5h, 6c), (4s, 5s, 6c)), (4s, 5c, 6c), (5h, 5s, 5c) | 8 points |
| three pairs<br>(5h, 5s), (5h, 5c), (5s, 5c) | 6 points |
| three runs of three cards<br>(4s, 5h, 6c), (4s, 5s, 6c), (4s, 5c, 6c) | 9 points |
| Total point value | 23 points |

Similarly, Player 5 is dealt the Ah,4h,Kd,Kh, and 2c, discards the 2c, and computes a total point value as follows:

| | |
|---|---|
| four combinations of 15<br>(Ah, 4h, Kd), (Ah, 4h, Kh), (Kd, 5c), (Kh, 5c) | 8 points |
| one pair<br>(Kd, Kh) | 2 points |
| Total point value | 10 points |

Similarly, Player 6 is dealt the 9c,10s,Jc,Qh, and Ad, discards the Ad, and computes a total point value as follows:

| | |
|---|---|
| three combinations of 15<br>(10s, 5c), (Jc, 5c), (Qh, 5c) | 6 points |
| one run of four cards<br>(9c, 10s, Jc, Qh) | 4 points |
| Jack of the suit of the Starter Card ("Nobs")<br>(Jc) | 1 point |
| Total point value | 11 points |

Similarly, Player 7 is dealt the 3d,3s,4c,Qd, and 9d, discards the 9d, and computes a total point value as follows:

| | |
|---|---|
| two combinations of 15<br>(3d, 3s, 4c, 5c), (Qd, 5c) | 4 points |
| one pair<br>(3d, 3s) | 2 points |
| two runs of three cards<br>(4s, 5h, 6c), (4s, 5s, 6c), (4s, 5c, 6c) | 6 points |
| Total point value | 12 points |

Similarly, Player 8 is dealt the 10c,10d,10h,Jh, and Ac, discards the Ac, and computes a total point value as follows:

| | |
|---|---|
| four combinations of 15<br>(10c, 5c), (10d, 5c), (10h, 5c), (Jh, 5c) | 8 points |
| three pairs<br>(10c, 10d), (10c, 10h), (10d, 10h) | 6 points |
| Total point value | 14 points |

Similarly, the Banker is dealt the 2d,3h,3c,4d, and 7d, discards the 7d, and computes a total point value as follows:

| | |
|---|---|
| one combination of 15<br>(3h, 3c, 4d, 5c) | 2 points |
| one pair<br>(3h, 3c) | 2 points |
| two runs of four cards<br>(2d, 3h, 4d, 5c), (2d, 3c, 4d, 5c) | 8 points |
| Total point value | 12 points |

In step (g), each player compares their total point value of step (f) with the total point value of banker. The comparison is typically performed progressing from player to player sequentially around the playing table 500.

The round of play ends with step (h), wherein in step (g) if the total point value of a player is greater than the total point value of the banker the player wins the wager of step (b), or conversely if the total point value of the player is less than the total point value of the banker the banker wins the wager of step (b).

Referring to Table 1, Players 2, 4, and 8 have a greater total point value than the banker, and would therefore win their wagers. Players 1, 5, and 6 have a lower total point value than the banker, and would therefore lose their wagers. Players 3 and 7 have the same total point value as the banker, and would neither win nor lose their wager (a tie or push). However, in another embodiment of the invention, if the total point value of the player is equal to the total point value of the banker, the banker wins the wager of step (b). This embodiment gives a greater advantage to the banker. Therefore in this embodiment, Players 3 and 7 would lose their wagers to the banker.

In another embodiment of the invention, in step (e), if the starter card is a jack, the banker adds two points to his or her total point value of step (f).

In another embodiment of the invention, in step (c), one additional card is dealt to each player and to the banker (making a total of six dealt cards), and in step (d), each player and the banker keep four cards and discarding two cards. On average, this variation will lead to higher hand values for all of the players and for the banker.

In another embodiment of the invention, in step (c), one additional card is dealt only to the banker, and in step (d), the banker keeps four cards and discarding two cards. This embodiment will increase the banker's advantage, and would not generally be used with the embodiment where the banker takes pushes.

In another embodiment of the invention, in step (f), if the computed total point value is zero, the total point value is changed to 19. In Cribbage, it is impossible for a hand to have a total point value of 19. Thus to add an interesting feature to the present invention, if a dealt hand has no point value, and has little potential to be improved by the starter card, in selecting his or her discard, the player may choose to gamble and hope the starter card adds no point value thereby resulting in a total point value of zero. In this embodiment, the value of zero is automatically changed to a value of 19.

In another embodiment of the invention, prior to step (c), a player may optionally place a bonus wager. If the bonus wager is placed, the player will receive a bonus payoff if the total point value of player's hand has a predetermined value. For example, a maximum bonus payoff would be made for a hand have a total point value of 29 (the highest possible value). Lesser bonus payoffs could be made for hands having a value of 12, 16, and so on.

In another embodiment, a "Lowball" variation of the present invention may be played. The steps and variations of the lowball embodiment are identical to the previously described embodiments, except in step (h) instead of the greatest total point value winning, the lowest total point value wins. Therefore in step (g) if the total point value of the player is less than the total point value of the banker the player wins said wager of step (b), or conversely if the total point value of the player is greater than the total point value of the banker the banker wins the wager of step (b). Of course in this embodiment the playing strategy is reversed, and in their discard the players try to create a hand, which in combination with the starter card will have the minimum number of points. Also, while the previously described embodiment where a hand of zero points is automatically changed to 19 points could be used, it would however not generally be compatible with a lowball philosophy.

Figure 4A:
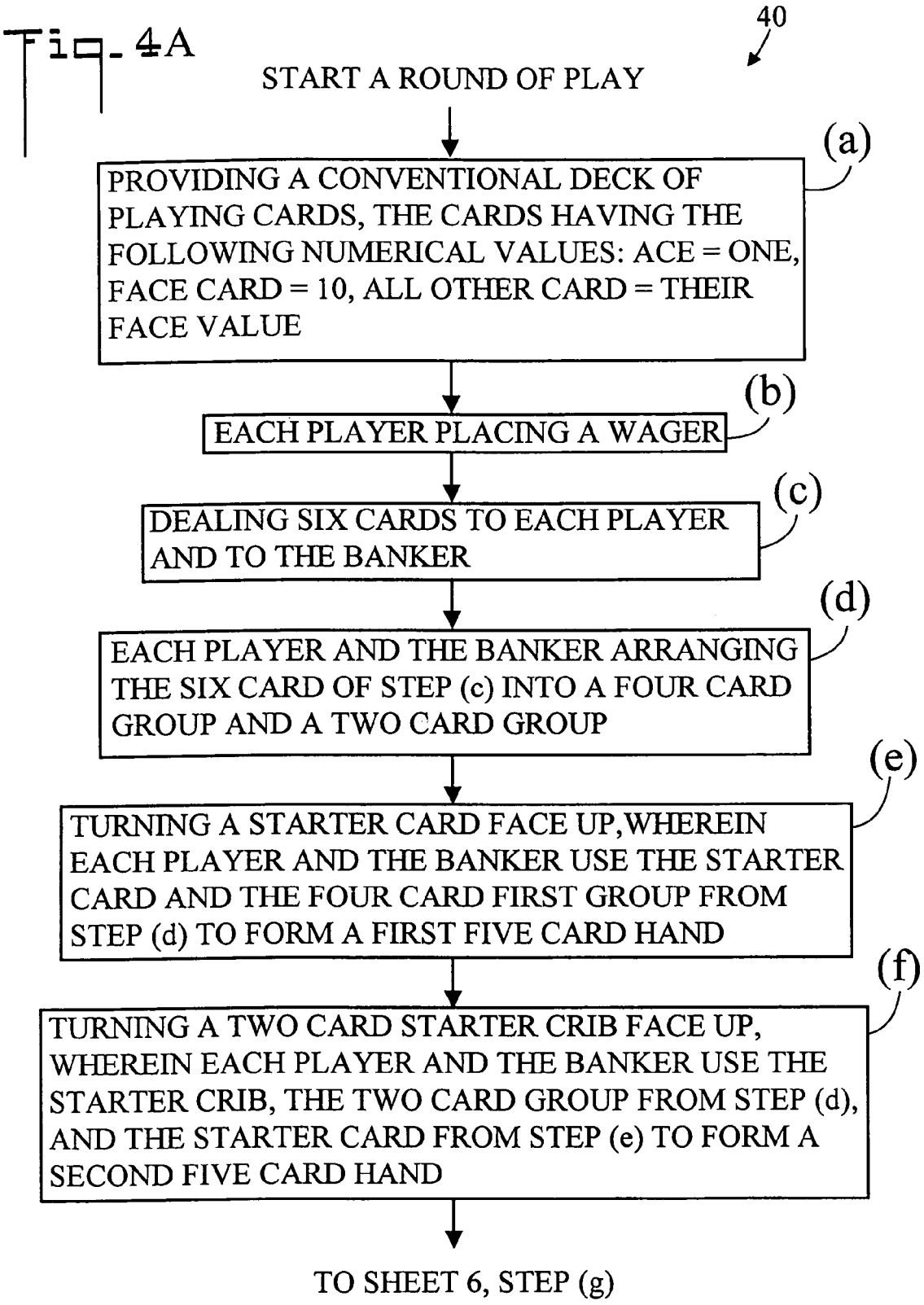
Figure 4B:
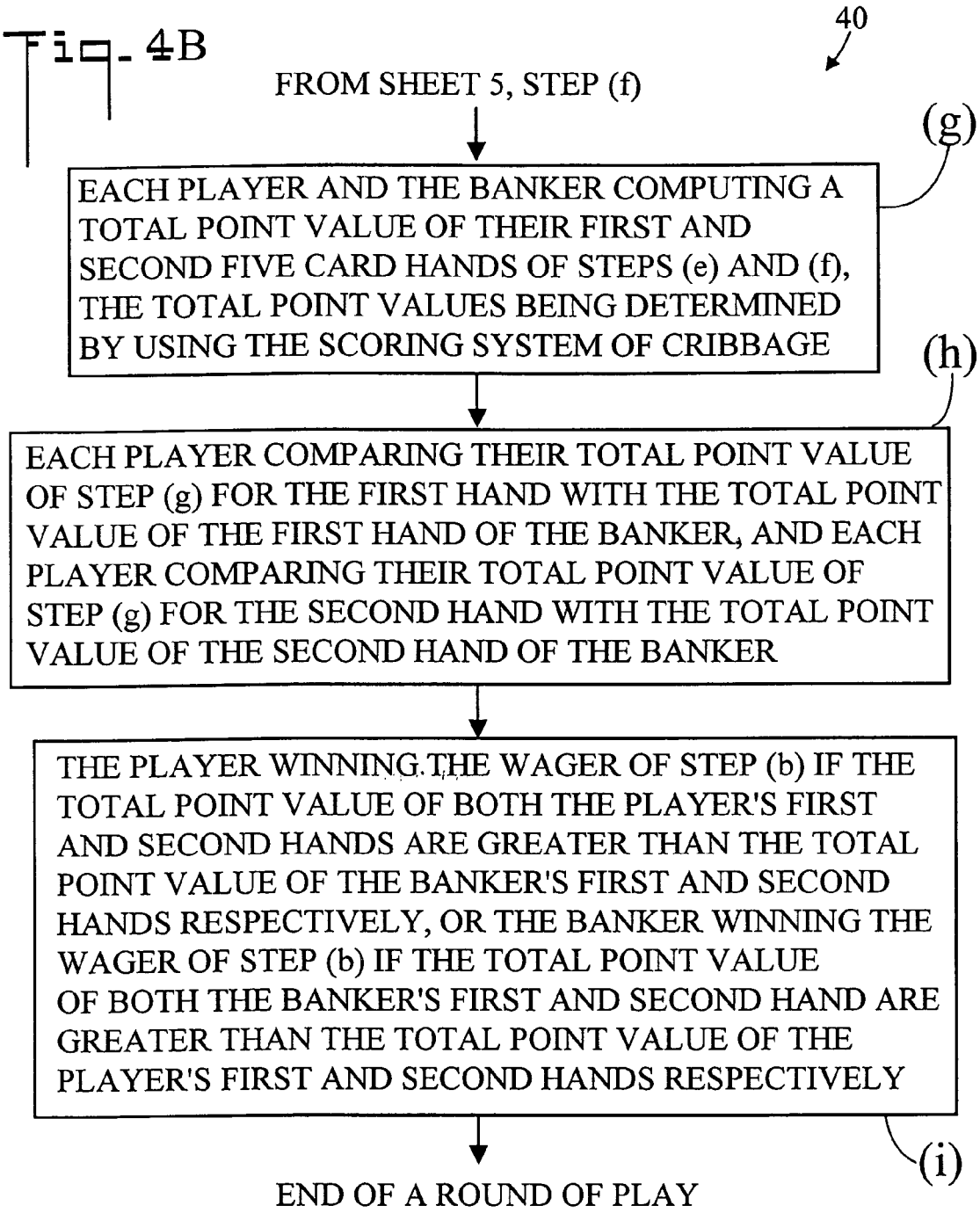

FIG. 4 is a flow chart depicting a method for playing a second embodiment of a wagering game between a banker and at least one player, generally designated as 40. This embodiment also includes the scoring system of cribbage, and additionally incorporates the two hand feature from the game of Pai Gow Poker. As with method 20, method 40 can include only one player and a banker, however a plurality of players are preferred.

A round of play commences with step (a) in which a conventional deck of cards is provided, the cards having the following numerical values:

an ace equals one;

face cards equal ten; and, all other cards equal their face value;

In step (b) each of the players places a wager.

In step (c) a dealer deals six cards from the deck of cards to each player and to the banker. The dealer may be the house banker (refer to FIG. 1), or a non-participating house dealer (refer to FIG. 2).

In step (d), each player and the banker arranging their six cards of step (c) into a four card group and a two card group;

In step (e), a starter card is turned face up from the deck, wherein each player and the banker use starter card and the four card group from step (d) to form a first five card hand;

In step (f), a two card starter crib is turned face up from the deck, wherein each player and the banker use the starter crib, the two card group from step (d), and the starter card from step (e) to form a second five card hand;

In step (g), each player and the banker compute a total point value for the first and second five card hands of steps (e) and (f) as follows:

two points for each combination of cards which numerically sum to 15;

two points for each pair of cards of the same rank (pair);

one point for each card in a sequence of three or more consecutive cards (run);

four points if all said four cards of step (d) are the same suit (four card flush);

five points if all said four cards of step (d) and said starter card of step (e) are the same suit (five card flush);

one point if one card of the four card group of step (d) is the jack of the suit of the starter card of step (e), or one point if one card of the two card group of step (d) is the jack of the suit of the starter card of step (e);

Table 2 provides a sample round of play showing the hands of each player and the banker in the Pai Gow embodiment of the present invention. In the sample, four players play against the banker.

TABLE 2

Sample Round of Play (Pai Gow embodiment)

| | | | | |
|---|---|---|---|---|
| Player 1 | Four Card Group | Starter Card | Score | |
| | 2h, 2s, 3d, 10s | 10d | 4 comb. of 15 = | 8 |
| | | | 2 pair = | 4 |
| | | | Total First Five Card Hand | 12 |
| | Two Card Group | Starter Crib | Score | |
| | 3s, Ks | 2d, 4d | 2 comb. of 15 = | 4 |
| | | | run of 3 = | 3 |
| | | | Total Second Five Card Hand | 7 |
| Player 2 | Four Card Group | Starter Card | Score | |
| | 3h, 4c, Jc, Kh | 10d | 0 points | |
| | | | Total First Five Card Hand = | 0 |

TABLE 2-continued

| Sample Round of Play (Pai Gow embodiment) | | | | |
|---|---|---|---|---|
| | Two Card Group | Starter Crib | Score | |
| | 5d, 6h | 2d, 4d | 2 comb. of 15 = | 4 |
| | | | run of 3 = | 3 |
| | | | Total Second Five Card Hand | 7 |
| Player 3 | Four Card Group | Starter Card | Score | |
| | 7h, 8c, 8d, 8s | 10d | 3 comb. of 15 = | 6 |
| | | | 3 pair = | 6 |
| | | | Total First Five Card Hand | 12 |
| | Two Card Group | Starter Crib | Score | |
| | Jd, Kd | 2d, 4d | flush of 5 = | 5 |
| | | | Nobs = | 1 |
| | | | Total Second Five Card Hand | 6 |
| Player 4 | Four Card Group | Starter Card | Score | |
| | 5s, 7c, Qc, Kc | 10d | 3 comb. of 15 = | 6 |
| | | | Total First Five Card Hand | 6 |
| | Two Card Group | Starter Crib | Score | |
| | Ac, Ad | 2d, 4d | 2 comb. of 15 = | 4 |
| | | | 1 pair = | 2 |
| | | | Total Second Five Card Hand | 6 |
| Banker | Four Card Group | Starter Card | Score | |
| | 5c, 8h, Qd, Qs | 10d | 3 comb. of 15 = | 6 |
| | | | 1 pair = | 2 |
| | | | Total First Five Card Hand | 8 |
| | Two Card Group | Starter Crib | Score | |
| | 9d, 9h | 2d, 4d | 2 comb. of 15 = | 4 |
| | | | 1 pair = | 2 |
| | | | Total Second Five Card Hand | 6 |

Referring to Table 2, in step (c), Player 1 is dealt the 2h, 2s, 3d, 10s, 3s, and Ks. In step (d), Player 1 arranges the six cards dealt is step (c) into a four card group (2h,2s,3d,10s) and a two card group (3s,Ks). In step (e), a starter card (10d) is turned face up from the cards remaining in the deck after the deal of step (c). The four card group is combined with the starter card to form a first five card hand. In step (f), a two card starter crib (2d,4d) is turned face up from the cards remaining in the deck. The two card group, two card crib, and the starter card are combined to form a second five card hand. In step (g), Player 1 computes the total point value for both the first five card hand and the second five card hand as follows:

First Five Card Hand:

| | |
|---|---|
| four combinations of cards which sum to 15<br>(2h, 3d, 10s), (2h, 3d, 10d), (2s, 3d, 10s), (2s, 3d, 10d) | 8 points |
| two pairs<br>(2h, 2s), (10s, 10d) | 4 points |
| Total point value | 12 points |

Second Five Card Hand:

| | |
|---|---|
| two combinations of cards which sum to 15<br>(3s, 2d, Ks), (3s, 2d, 10d) | 4 points |
| run of three cards<br>(2d, 3s, 4d) | 3 points |
| Total point value | 7 points |

In a similar fashion, the total point values for the first and second five card hands of Players 2-4 and the banker are computed, as is shown in Table 2.

In step (h), each player compares their total point value of step (g) for their first five card hand with the total point value of the first five card hand of the banker, and each player compares their total point value of step (g) for their second five card hand with the total point value of the second five card hand of the banker.

In step (i), in view of step (h), if the total point value of the player's first five card hand is greater than the total point value of the banker's first five card hand, and the total point value of said player's second five card hand is greater than the total point value of the banker's second five card hand, the player wins the wager of step (b), or if the total point value of the player's first five card hand is less than the total point value of the banker's first five card hand, and the total point value of the player's second five card hand is less than the total point value of the banker's second five card hand, the banker wins the wager of step (b). That is, in order to win the wager, either the player or the banker must win both the first and second five card hands.

Referring to Table 2, Player 1 has a greater total point value for both the first and second five card hands (player 12 and 7, vs banker 8 and 4). Therefore, Player 1 would win the wager of step (b). None of the other players win or lose both the first and second five card hands.

In another variation of the second embodiment of the invention, in step (h), if the total point value of the player's first five card hand is greater than the total point value of the banker's first five card hand and if the total point value of the player's second five card hand is less than the total point value of the banker's second five card hand, or if the total point value of the player's first five card hand is less than the total point value of the banker's first five card hand and if the total point value of the player's second five card hand is greater than the total point value of the banker's second five card hand, neither the player nor the banker winning said wager of step (b). In other words, if the player wins one of the five card hands and loses the other of the five card hands, then it is a push (tie) and neither the player nor the banker wins the wager of step (b). Referring again to Table 2, Player 2 loses the first five card hand (0 to 8), but wins the second five card hand (7 to 6). Therefore neither Player 2 nor the banker wins the wager. It is noted however, that if the previously described "zero points being changed to 19 points" embodiment were in effect, Player 2 would win both the first and second hands and therefore win the wager.

In another variation of the second embodiment, in step (h), if the total point value of the player's first five card hand is equal to the total point value of the banker's first five card hand and if the total point value of the player's second five card hand is greater than the total point value of the banker's second five card hand, or if the total point value of the player's first five card hand is greater than the total point value of the banker's first five card hand and if the total point value of the player's second five card hand is equal to the total point value of the banker's second five card hand, neither the player nor said banker winning wager of step (b). In other words, if the players wins one of the five card hands and ties the other of the five card hands, then it is a push and neither the player nor the banker wins the wager of step (b). Referring again to Table 2, Player 3 wins the first five card hand (12 to 6) and ties the second five card hand (6 to 6). Therefore neither Player 3 nor the banker wins the wager.

In another variation of the second embodiment, in step (h), if the total point value of the player's first five card hand is equal to the total point value of the banker's first five card hand and if the total point value of the player's second five card hand is less than the total point value of the banker's second five card hand, or if the total point value of the player's first five card hand is less than the total point value of the banker's first five card hand and if the total point value of the player's second five card hand is equal to the total point value of the banker's second five card hand, the banker wins the wager of step (b). In other words, if the player loses one of the five card hands and ties the other of the five card hands, the banker wins the wager of step (b). Referring again to Table 2, Player 4 loses the first five card hand (6 to 8) and ties the second five card hand (6 to 6). Therefore the banker wins the wager.

In another embodiment of the invention, in step (e), if the starter card is a jack, the banker adds two points to his or her total point value of step (f).

In another variation of the second embodiment, in step (f), if the computed total point value is zero, the total point value is changed to 19. In Cribbage, it is impossible for a hand to have a total point value of 19. Thus to add an interesting feature to the present invention, if a dealt hand has no point value, and has little potential to be improved by the starter card, in the selection of his or her discard, the player may choose to gamble and hope the starter card adds no point value thereby resulting in a total point value of zero. In this embodiment, the value of zero is automatically changed to a value of 19.

In another variation of the second embodiment, in step (e), if the starter card is a jack, the banker adds two points to his or her total point value of step (g).

In another variation of the second embodiment, prior to step (c), a player may optionally place a bonus wager. If the bonus wager is placed, the player will receive a bonus payoff if total point value of player's hand has a predetermined value. For example, a maximum bonus payoff would be made for a hand have a total point value of 29 (the highest possible value). Lesser bonus payoffs could be made for hands having a value of 12, 16, and so on.

In another variation of the second embodiment, a "Lowball" variation may be played. The steps and variations of the lowball embodiment are identical to the previously described embodiment, except in step (h) the player wins if the total point value of both his or her first and second five card hands are less than those of the banker. That is, if the total point value of the player's first five card hand is less than the total point value of the banker's first five card hand and the total point value of the player's second five card hand is less than the total point value of the banker's second five card hand the player winning said wager of step (b), or if the total point value of the player's first five card hand is greater than the total point value of the banker's first five card hand and the total point value of the player's second five card hand is greater than the total point value of the banker's second five card hand the banker winning the wager of step (b).

The preferred embodiments of the invention described herein are exemplary and numerous modifications, variations, and rearrangements can be readily envisioned to achieve an equivalent result, all of which are intended to be embraced within the scope of the appended claims.

I claim:

1. A method for playing a wagering game between a banker and at least one player, comprising:

(a) providing a conventional deck of cards, the cards having the following numerical values:
an ace equals one;
face cards equal ten; and,
all other cards equal their face value;

(b) each said player placing a wager;

(c) dealing five cards from said deck to each said player and to said banker;

(d) each said player and said banker keeping four cards and discarding a card the discard choice being selected from one of the following selections;
(d1) selecting a card that will leave a zero point value for the remaining four cards; or
(d2) selecting a card that will retain a point value for the four remaining cards;

(e) from said deck turning a starter card face up, wherein each said player and said banker use said starter card and said four cards from step (d) to form a five card hand;

(f) each said player and said banker computing a total point value for their said five card hands of step (e) as follows:
two points for each combination of cards which numerically sum to 15;
two points for each pair of cards of the same rank;
one point for each card in a sequence of three or more consecutive cards;
four points if all said four cards of step (d) are the same suit;
five points if all said four cards of step (d) and said starter card of step (e) are the same suit;
one point if one of said four cards of step (d) is the jack of the suit of said staffer card of step (e);

(g) each said player comparing their said total point value of step (f) with said total point value of said banker; and, (h) in step (g) if said total point value of said player is greater than said total point value of said banker said player winning said wager of step (b), or if said total point value of said player is less than said total point value of said banker said banker winning said wager of step (b) and further wherein, in step (f) if said computed total value is zero, said total point value being changed to 19.

2. The method of claim 1 further wherein, if a player and the banker tie, it is a push.

3. The method of claim 1 further wherein, if a player and the banker tie at 19 and no other player is higher, the banker wins.

* * * * *